US009077094B2

(12) United States Patent
Minich

(10) Patent No.: US 9,077,094 B2
(45) Date of Patent: Jul. 7, 2015

(54) ELECTRICAL CONNECTOR ASSEMBLY HAVING REDUCED STUB LENGTH

(71) Applicant: Steven E. Minich, York, PA (US)

(72) Inventor: Steven E. Minich, York, PA (US)

(73) Assignee: FCI AMERICAS TECHNOLOGY LLC, Carson City, NV (US)

( * ) Notice: Subject to any disclaimer, the term of this patent is extended or adjusted under 35 U.S.C. 154(b) by 206 days.

(21) Appl. No.: 13/711,103

(22) Filed: Dec. 11, 2012

(65) Prior Publication Data

US 2013/0196551 A1 Aug. 1, 2013

Related U.S. Application Data

(60) Provisional application No. 61/592,452, filed on Jan. 30, 2012, provisional application No. 61/593,029, filed on Jan. 31, 2012.

(51) Int. Cl.

| | |
|---|---|
| ***H01R 13/648*** | (2006.01) |
| ***H01R 13/42*** | (2006.01) |
| ***H01R 13/658*** | (2011.01) |
| ***H01R 12/50*** | (2011.01) |
| ***H01R 13/514*** | (2006.01) |
| ***H01R 13/6471*** | (2011.01) |
| ***H01R 13/26*** | (2006.01) |
| *H01R 13/24* | (2006.01) |
| *H01R 13/6587* | (2011.01) |

(52) U.S. Cl.

CPC ..... *H01R 13/42* (2013.01); *H01R 13/65807* (2013.01); *H01R 23/688* (2013.01); *H01R 13/514* (2013.01); *H01R 13/6471* (2013.01); *H01R 13/65802* (2013.01); *H01R 13/2492* (2013.01); *H01R 13/26* (2013.01); *H01R 13/6587* (2013.01)

(58) Field of Classification Search

USPC ..... 439/660, 607.07, 79, 862, 884

See application file for complete search history.

(56) References Cited

U.S. PATENT DOCUMENTS

| | | | | |
|---|---|---|---|---|
| 2,049,560 | A * | 8/1936 | Ezzo | 439/695 |
| 3,136,591 | A * | 6/1964 | Just et al. | 439/79 |
| 3,192,498 | A * | 6/1965 | Ruehlemann | 439/223 |
| 3,555,497 | A * | 1/1971 | Watanabe | 439/857 |
| 4,026,627 | A * | 5/1977 | Benasutti | 439/377 |
| 4,778,231 | A * | 10/1988 | Seidler et al. | 439/857 |
| 5,591,054 | A * | 1/1997 | Okada et al. | 439/884 |
| 5,989,053 | A * | 11/1999 | Wheeler | 439/387 |
| 6,056,603 | A * | 5/2000 | Pauza | 439/733.1 |
| 6,554,647 | B1 * | 4/2003 | Cohen et al. | 439/607.07 |
| 6,971,928 | B2 * | 12/2005 | Shindo et al. | 439/857 |
| 7,090,512 | B2 * | 8/2006 | Laub et al. | 439/79 |
| 7,494,379 | B2 | 2/2009 | Do et al. | |
| 7,527,529 | B2 * | 5/2009 | Ho et al. | 439/660 |
| 7,819,697 | B2 * | 10/2010 | Glover et al. | 439/607.07 |
| 2009/0011664 | A1 | 1/2009 | Laurx et al. | |
| 2009/0239395 | A1 | 9/2009 | Cohen et al. | |

* cited by examiner

*Primary Examiner* — Neil Abrams
*Assistant Examiner* — Travis Chambers
(74) *Attorney, Agent, or Firm* — Baker & Hostetler LLP

(57) ABSTRACT

An electrical connector includes a dielectric housing and a plurality of electrical contacts carried by the dielectric housing. The electrical contacts can each define a mating portion that is configured to mate with a complementary mating portion of a complementary electrical connector. When the electrical connector is mated with a complementary electrical connector, a plurality of contact surfaces of the mating portions can contact a complementary mating portion, so as to establish an electrical connection between the electrical connector and the complementary electrical connector.

26 Claims, 10 Drawing Sheets

ELECTRICAL CONNECTOR ASSEMBLY HAVING REDUCED STUB LENGTH

CROSS-REFERENCE TO RELATED APPLICATIONS

This claims the benefit of U.S. Provisional Patent Application Ser. No. 61/592,452 filed Jan. 30, 2012, and further claims the benefit of U.S. Provisional Patent Application Ser. No. 61/593,029 filed Jan. 31, 2012, the disclosure of each of which is hereby incorporated by reference as if set forth in its entirety herein.

BACKGROUND

Electrical connectors provide signal connections between electronic devices using electrically-conductive contacts. Electrical connectors can include receptacle connectors having receptacle contacts, and complementary header connectors having header contacts that are configured to mate with the receptacle contacts. For instance, as illustrated in FIG. 1, the receptacle contacts 20 can each include a body portion 21 having a receptacle mating portion 22 that defines a proximal end 24 connected to a body portion of the receptacle contact 20, and a free distal end 26 opposite the proximal end 24. The receptacle mating portion 22 can include a projection 28 disposed proximate to the distal end 26. The header contacts 30 can similarly include a header mating portion 32 that defines a proximal end 34 that is connected to a body portion of the header contact 30, and a free distal end 36 opposite the proximal end 34. The header mating portion 32 can be configured as a substantially straight beam that rides along the projection 28 of the receptacle mating portion 22 as the receptacle contacts 20 are mated with the header contacts 30. When the receptacle contacts 20 and header contacts 30 are mated, the header mating portion 32 defines a stub length SL1 that can be defined as the distance between a location 38 of the header mating portion 32 that is in contact with the projection 28 and the distal end 36 of the header mating portion 32.

SUMMARY

In accordance with one embodiment, an electrical contact is configured to mate with a complementary electrical contact of a second electrical connector along a longitudinal direction. The electrical contact can include a mounting portion configured to electrically connect to a substrate, a mating portion configured to mate with mating portions of the complementary electrical contact, and an intermediate portion that is configured to be supported by a connector housing and extends between the mating portion and the mounting portion. The mating portion can include first and second contact beams spaced from each other along a transverse direction that is substantially perpendicular to the longitudinal direction. Each of the first and second contact beams can define an inner surface that faces the inner surface of the other of the first and second contact beams. The mating portion can further include at least one contact member that extends from the inner surface of at least one of the first and second contact beams along a direction that has a directional component toward the other of the first and second contact beams. The at least one contact member can define a contact surface that is configured to contact the complementary electrical contact when the electrical contact is mated with the complementary electrical contact.

BRIEF DESCRIPTION OF THE DRAWINGS

The foregoing summary, as well as the following detailed description of example embodiments of the application, will be better understood when read in conjunction with the appended drawings. For the purposes of illustrating the electrical connector system of the present application, there is shown in the drawings an example embodiment. It should be understood, however, that the application is not limited to the precise arrangements and instrumentalities shown. In the drawings.

DETAILED DESCRIPTION

Figure 1:
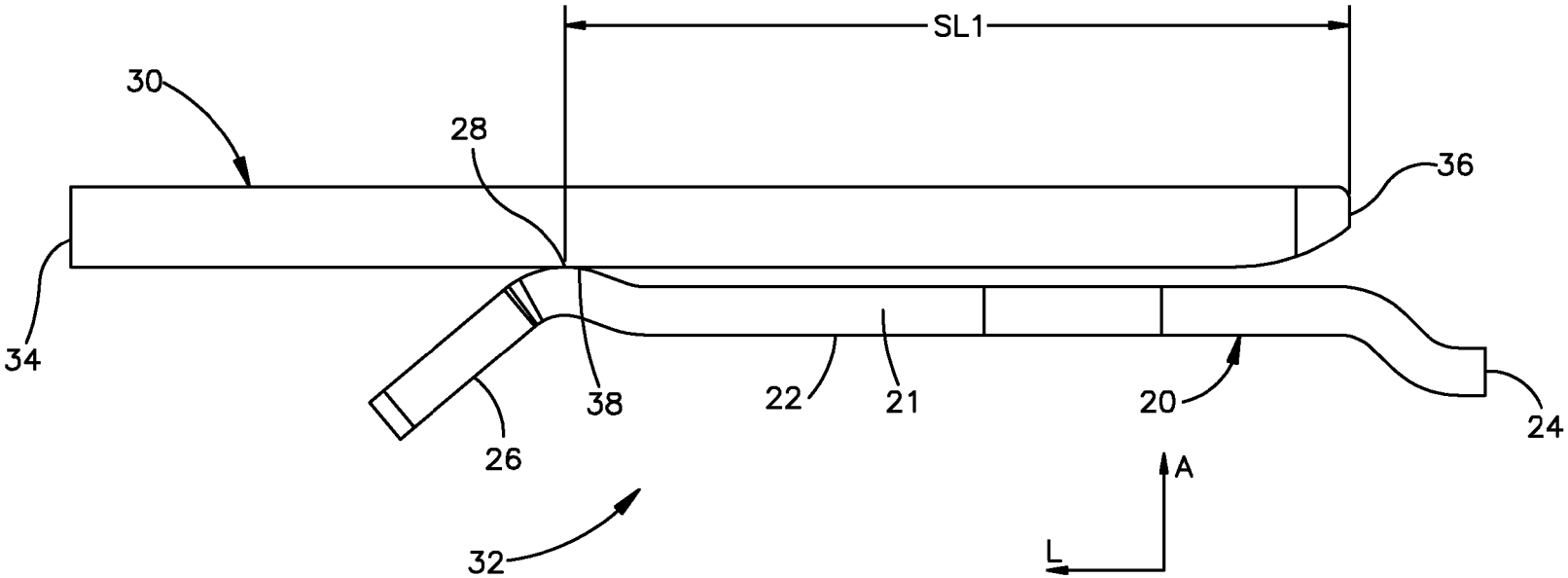
Fig.1 PRIOR ART
FIG. 1 is a top plan view of a portion of a conventional electrical contact mating interface, including a mating portion of an electrical contact of a header connector mated with a mating portion of a receptacle contact of a receptacle connector.

For convenience, the same or equivalent elements in the various embodiments illustrated in the drawings have been identified with the same reference numerals. Certain terminology is used in the following description for convenience only and is not limiting. The words "left," "right," "front," "rear," "upper," and "lower" designate directions in the drawings to which reference is made. The words "forward," "forwardly," "rearward," "inner," "inward," "inwardly," "outer," "outward," "outwardly," "upward," "upwardly," "downward," and "downwardly" refer to directions toward and away from, respectively, the geometric center of the object referred to and designated parts thereof. The terminology intended to be non-limiting includes the above-listed words, derivatives thereof and words of similar import.

Figure 2:
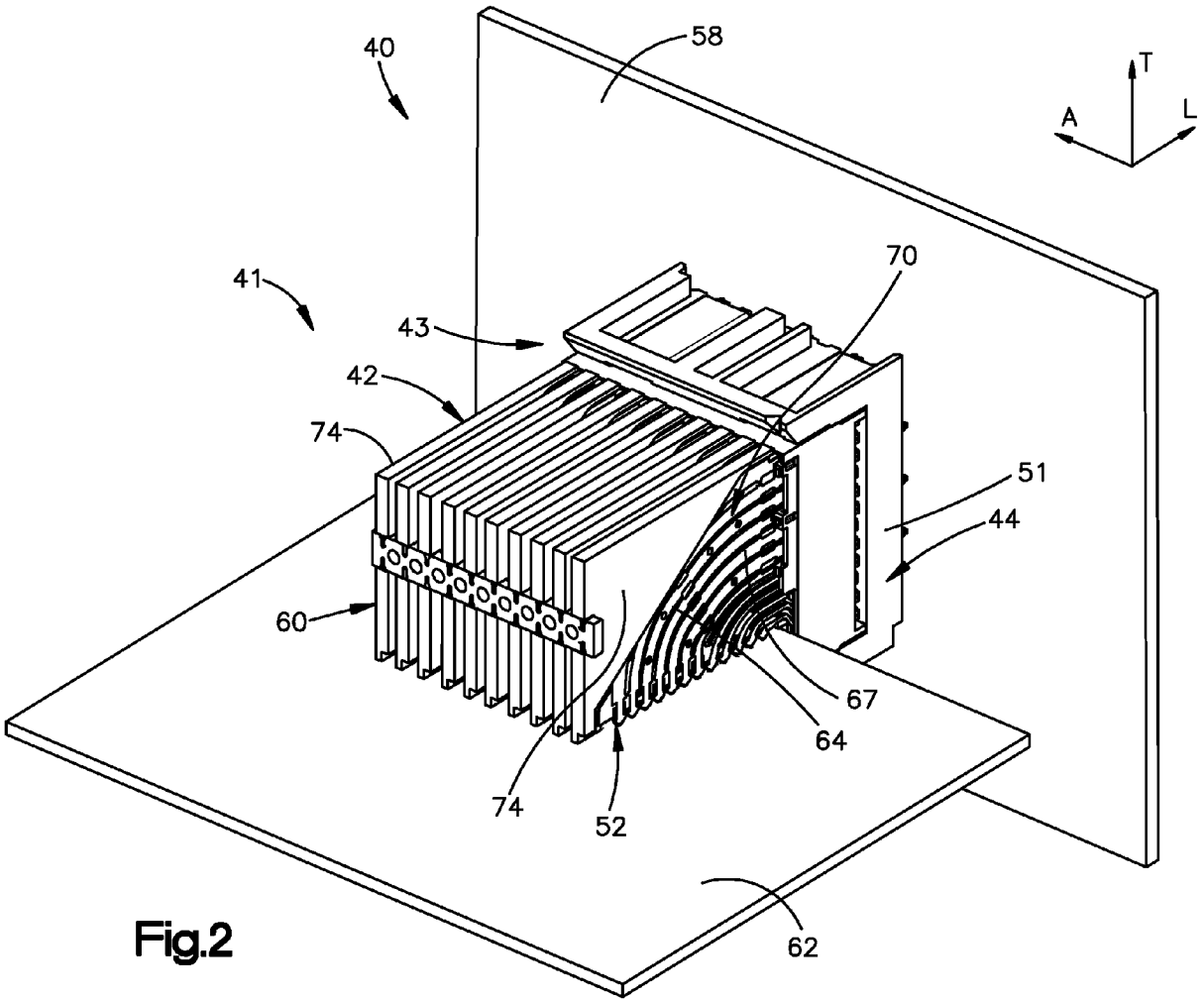
FIG. 2 is a perspective view of an electrical connector system constructed in accordance with one embodiment including a first electrical connector assembly that includes a right-angle receptacle connector mounted to an underlying substrate and a second electrical assembly that includes a vertical header connector mounted to an underlying substrate, whereby the first electrical connector assembly is mated with the second electrical connector assembly.
Figure 3:
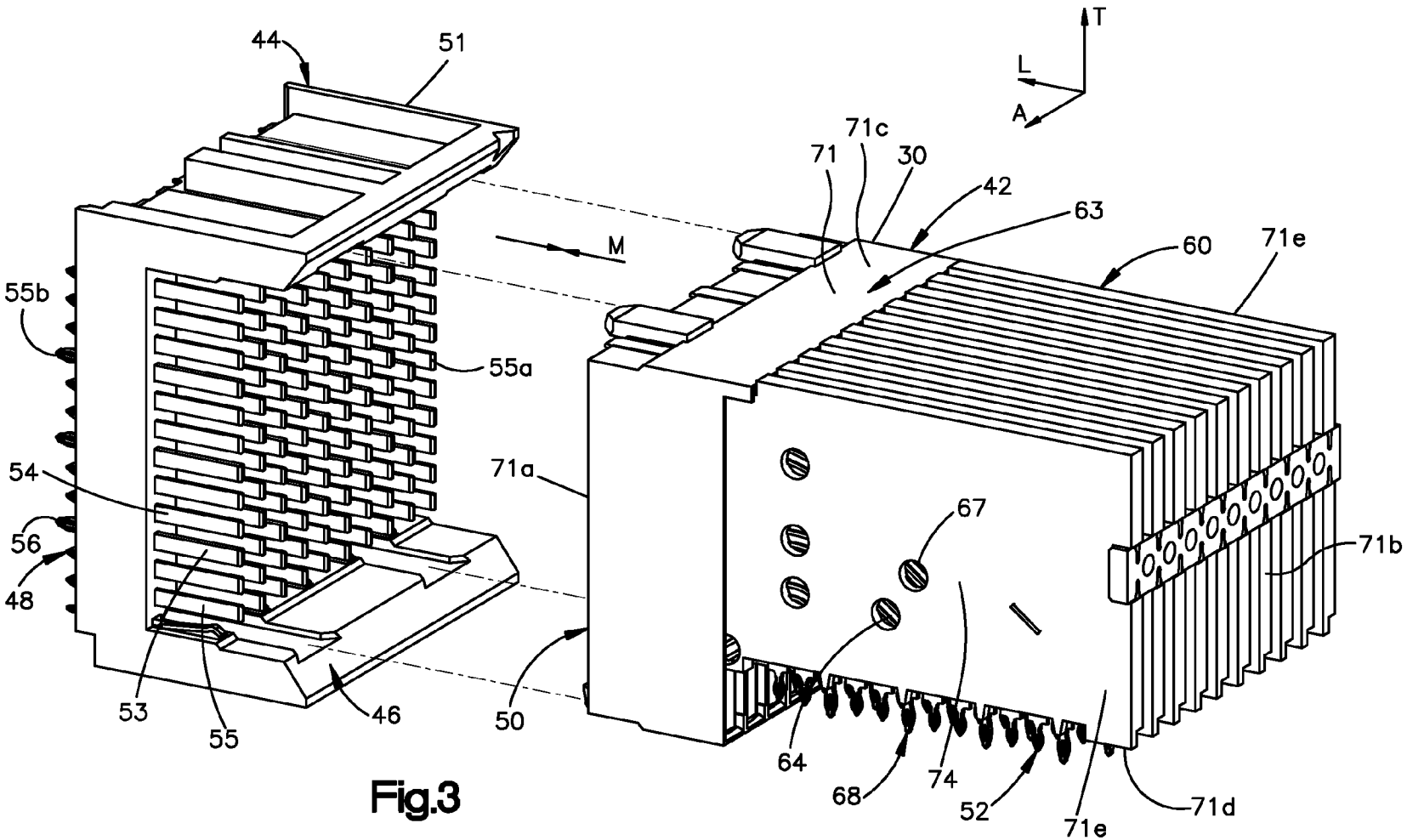
FIG. 3 is an exploded perspective view of the electrical connectors illustrated in FIG. 2, showing the electrical connectors in an unmated position and aligned for mating.
Figure 4:
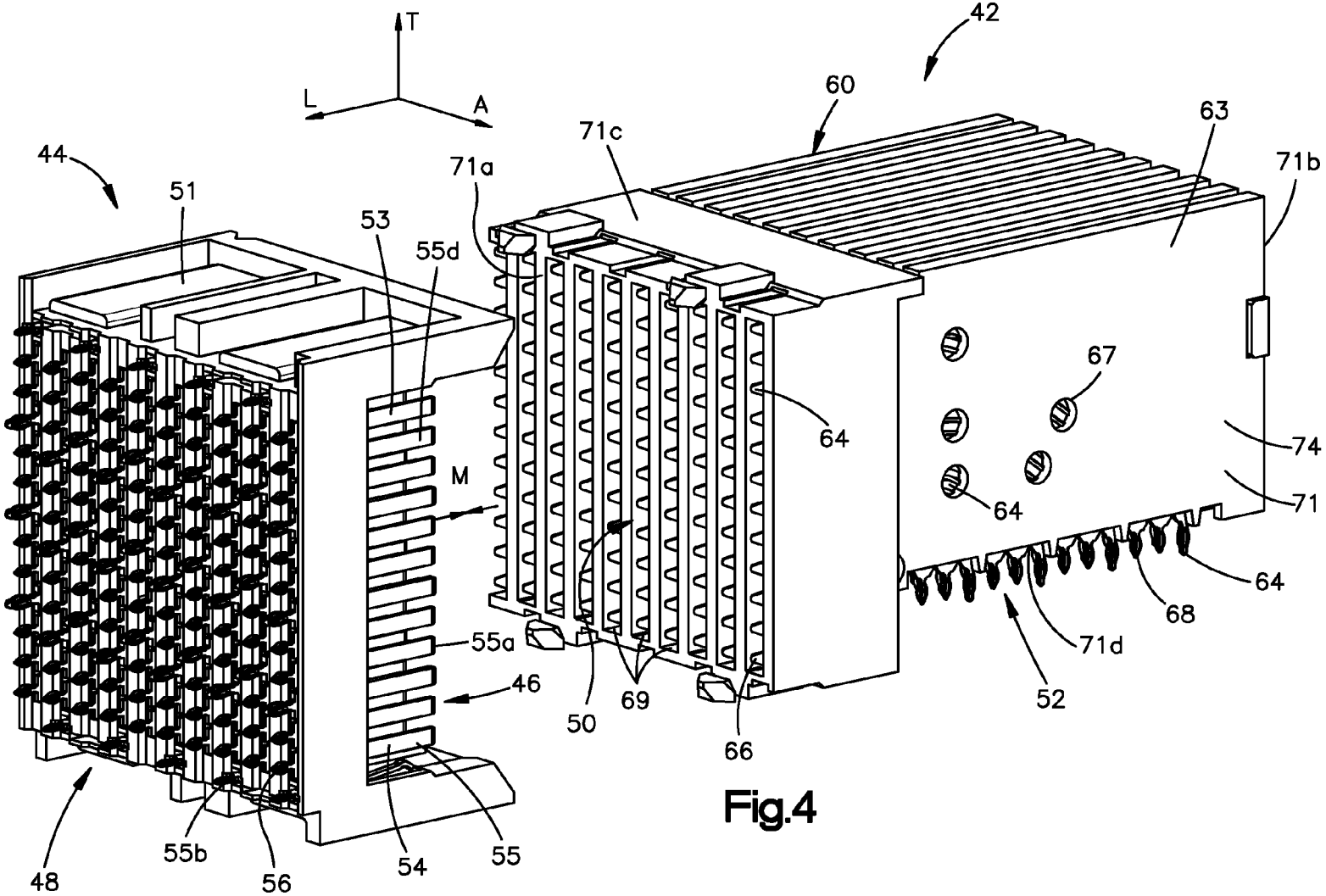
FIG. 4 is another exploded perspective view of the electrical connectors illustrated in FIG. 2, showing the electrical connectors in an unmated position and aligned for mating.

Referring initially to FIGS. 2-4, in accordance with one embodiment, an electrical connector system 40 can include a first electrical connector assembly 41 that is configured to be mated with a second or complementary electrical connector assembly 43. The first electrical connector assembly 41 can include a first electrical connector 42 and a first electrical component such as a first substrate 62, and the complementary electrical assembly can include a second or complementary electrical connector 44 and a second electrical component such as a second substrate 58. The electrical connectors 42 and 44 can be configured to be mated with each so as to establish an electrical connection between the connectors 42 and 44, and thus between the first and complementary electrical connector assemblies 41 and 43, respectively. The first electrical connector 42 can be configured to be mounted to the substrate 62 and the complementary electrical connector 44 can be configured to be mounted to the substrate 58 so as to establish an electrical connection between substrates 58 and 62. The substrates 58 and 62 can be provided as a backplane, midplane, daughtercard, or the like.

The first electrical connector 42 can include a first dielectric or electrically insulative connector housing 63 and at least one such as a plurality of first electrical contacts 64 that are supported by the connector housing 63. For instance, the first electrical connector 42 can include a plurality of leadframe assemblies 60 that are supported by the first connector housing 63 (see FIG. 5). Each of the leadframe assemblies 60 can include a dielectric or electrically insulative leadframe housing 74 that carries a respective plurality of the electrical contacts 64. Thus, it can be said that the electrical contacts 64 are supported by both the respective leadframe housing 74 and the first connector housing 63. When the first electrical connector 42 is mounted to the substrate 62 along a mounting direction, the electrical contacts 64 are placed in electrical communication with electrical traces of the substrate 62. The complementary electrical connector 44 can include a dielectric or electrically insulative connector housing 51 and at least one such as a plurality of second or complementary electrical contacts 53 that are supported by the connector housing 51. When the complementary electrical connector 44 is mounted to the substrate 58, the electrical contacts 53 are placed in electrical communication with electrical traces of the substrate 58. The first electrical connector 42 can be configured to mate with the complementary electrical connector 44 so as to establish an electrical connection between the first and complementary electrical contacts 64 and 53, respectively, and thus also between the electrical traces of the substrates 58 and 62.

In accordance with the illustrated embodiment, the first electrical connector 42 can be constructed as a right-angle receptacle connector that includes the connector housing 63. The connector housing 63 defines a first mating interface 50 and a first mounting interface 52 that extends substantially perpendicular to the mating interface 50. The mating interface 50 can be configured to be mated with the complementary electrical connector 44 and the mounting interface 52 can be configured to be mounted onto an electrical component. In accordance with the illustrated embodiment, the complementary electrical connector 44 can be constructed as a vertical header connector that defines a second or complementary mating interface 46 and a second or complementary mounting interface 48 that extends substantially parallel to the complementary mating interface 46. The mating interface 50 of the first electrical connector 42 can be configured to mate with the complementary mating interface 46 of the complementary electrical connector 44 that is to be mated with first electrical connector 42. The first and complementary mounting interfaces 52 and 48, respectively, can be configured to mount onto underlying substrates, such as the respective substrates 58 and 62. The mating interface 50 of the first electrical connector 42 can include receptacle windows 69 that are defined by the first connector housing 63, such that the electrical contacts 53 of the complementary electrical connector 44 can be received in receptacle windows 69 when the first electrical connector 42 is mated with the complementary electrical connector 44. As shown in the illustrated embodiment, the first electrical connector 42 can be configured as a receptacle connector and the complementary electrical connector 44 can be configured as a header connector, such that the connector housing 63 is configured to receive the connector housing 51 so as to mate the first and second electrical connectors 42 and 44, respectively.

Figure 5:
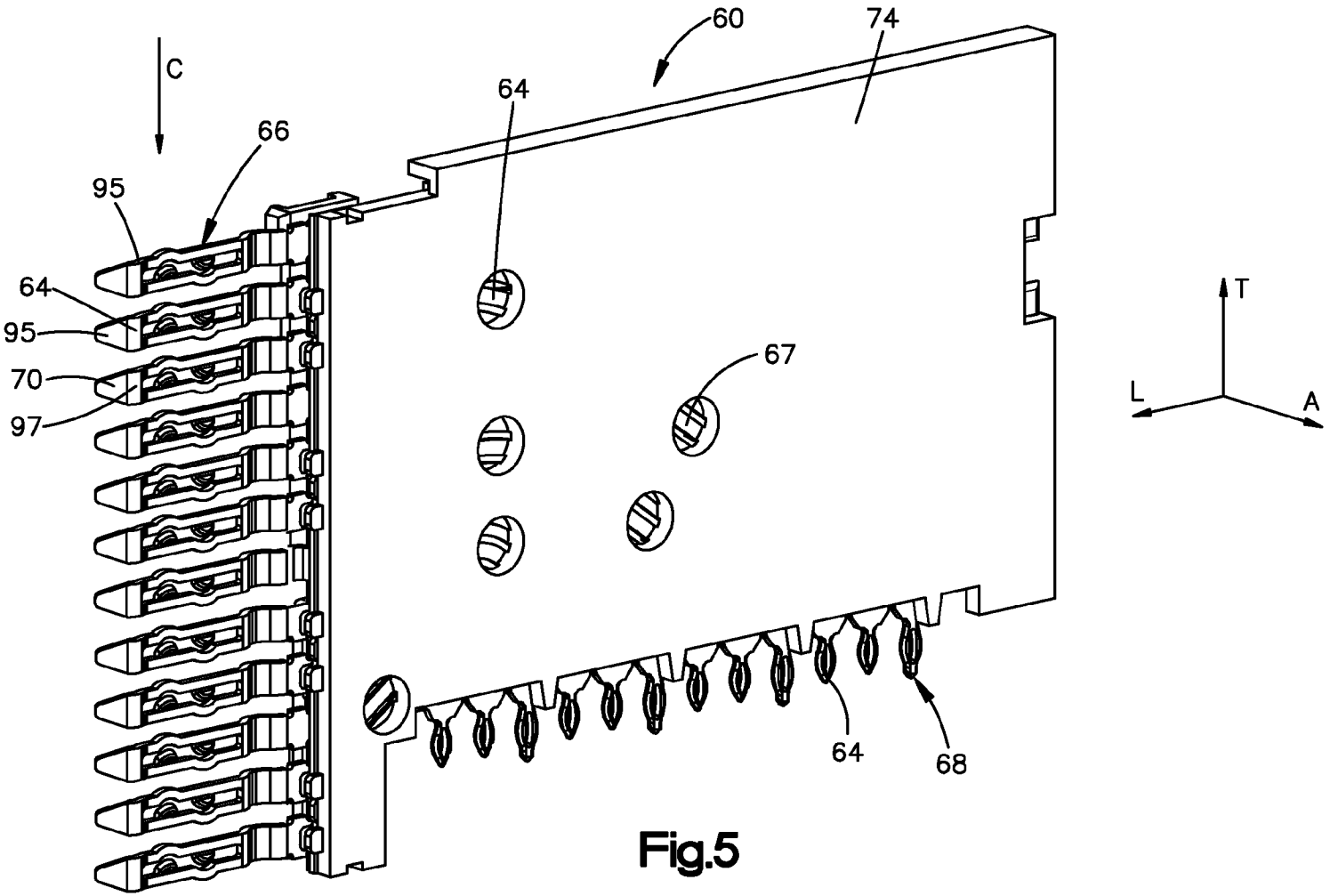
FIG. 5 is a perspective view of a leadframe assembly of the right-angle receptacle connector shown in FIGS. 2-4.

Referring also to FIG. 5, the first electrical connector 42 can include a plurality of leadframe assemblies 60 supported by the first connector housing 63. Each of the leadframe assemblies 60 can include a dielectric or electrically insulative leadframe housing 74 that carries a respective plurality of the electrical contacts 64. Thus, it can be said that the electrical contacts 64 are carried by the first connector housing 63. The leadframe assemblies 60 can be configured as insert molded leadframe assemblies (IMLAs) whereby the leadframe housing 74 is overmolded onto the respective plurality of electrical contacts 64. Alternatively, the electrical contacts 64 can be stitched into the leadframe housing 74 or otherwise supported by the leadframe housing 74.

Various structures are described herein as extending horizontally along a first or longitudinal direction "L" and a third or lateral direction "A" that is substantially perpendicular to the longitudinal direction L, and vertically along a second or transverse direction "T" that is substantially perpendicular to the longitudinal and lateral directions L and A, respectively. As illustrated, the longitudinal direction "L" extends along a forward/rearward direction of the first electrical connector 42, and defines a mating direction M along which one or both of the electrical connectors 42 and 44 are moved relative to the other so as to mate the first electrical connector assembly 41 with the complementary electrical connector assembly 43, and thus to mate the first electrical connector 42 with the complementary electrical connector 44. For instance, the mating direction M of the first electrical connector 42 is in a forward direction along longitudinal direction L, and the electrical connector can be unmated from the complementary connector 44 by moving the first electrical connector 42 in an opposed longitudinally rearward direction relative to the complementary connector 44. As illustrated, the first electrical connector 42 can be moved relative to the substrate 62 along the transverse direction T that defines a first mounting direction, and the complementary electrical connector 44 can be moved relative to the substrate 58 along the longitudinal direction L to define a second or complementary mounting direction. As illustrated, the lateral direction "A" extends along a width of the first electrical connector 42.

Thus, unless otherwise specified herein, the terms "lateral," "longitudinal," and "transverse" are used to describe the orthogonal directional components of various components. The terms "inboard" and "inner," and "outboard" and "outer" and like terms when used with respect to a specified directional component are intended to refer to directions along the directional component toward and away from the center of the apparatus being described. Further, the term "in" when used with a specified direction component is intended to refer to the single specified direction, and the term "along" when used with a specified direction component is intended to refer to both directions (i.e., toward and away) of the specified direction component. It should be appreciated that while the longitudinal and lateral directions are illustrated as extending along a horizontal plane, and that while the transverse direction is illustrated as extending along a vertical plane, the planes that encompass the various directions may differ during use, depending, for instance, on the orientation of the various components. Accordingly, the directional terms "vertical" and "horizontal" are used to describe the electrical connector system 40 and its components as illustrated merely for the purposes of clarity and convenience, it being appreciated that these orientations may change during use.

Referring to FIGS. 3-4, in accordance with the illustrated embodiment, the first connector housing 63 includes a housing body 71. The electrical connector includes a front end 71*a*, which can be defined by the housing body 71, and an opposed rear end 71*b*, which can be defined by the leadframe housings 74. The rear end 71*b* can be spaced from the front end 71*a* along the longitudinal direction L. The front end 71*a* can generally lie in a plane defined by the transverse and lateral directions T and A, respectively. The front end 71*a* can define the first mating interface 50 that is configured to be mated with the complementary electrical connector 44 so as to place the first electrical connector 42 in electrical communication with the complementary electrical connector 44. The electrical connector 42 can further include an upper end 71*c* and an opposed lower end 71*d* that is spaced from the upper end 71*c* along the transverse direction T. The upper and lower ends 71*c* and 71*d* can be defined by the leadframe housings 74. The lower end 71*d* can define a first mounting interface 52 that is configured to be mounted to the first substrate 62. The lower end 71*d* can generally lie in a plane defined by the longitudinal and lateral directions L and A, respectively. The electrical connector 42 can further include first and second opposed sides 71*e* that are spaced from each other along the lateral direction A. The sides 71*e* can be defined by one or both of the connector housing 63 and the leadframe housings 74. While the lateral and longitudinal directions A and L, respectively, extend horizontally and the transverse direction T extends vertically in accordance with the illustrated orientation of the electrical connector system 40, it should be appreciated that the orientation of the electrical connector system can vary as desired.

With reference to FIGS. 2 and 5, the electrical contacts 64 of the first electrical connector 42 can include respective contact bodies 70 that define respective first mating portions 66 that are disposed proximate to the mating interface 50 and are configured to be electrically mated to a complementary electrical component, such as the electrical contact 53 of the complementary electrical connector 44. For instance, the mating portions 66 can be disposed in a receptacle disposed at the mating interface 50, for instance in one of the receptacle windows 69. The mating portions 66 can be elongate along the mating direction M that is perpendicular to the first mounting direction of the first electrical connector 42. The electrical contacts 64 can further define respective first mounting portions 68 that can be configured as mounting tails, such as press-fit tails, that are disposed proximate to the mounting interface 52 and can be configured to be mounted to the underlying substrate 62 and can be configured to electrically connect to the substrate 62. For instance, the mounting portions 68 can be press-fit tails and can be configured to be inserted, or press-fit, into respective vias of the substrate 62, thereby electrically connecting the mounting portions 68 and the corresponding electrical contacts 64 to respective electrical traces of the substrate 62 when the electrical connector 42 is mounted to the substrate 62. The mounting portions 68 can be oriented along the transverse direction T. The vias can be configured as plated through-holes that electrically connect the mounting portions 68 to respective electrical traces of the underlying substrate 62. While the mounting portions 68 of the electrical contacts 64 are configured as press-fit tails, it should be appreciated that the mounting portions can be configured to be placed in electrical communication with electrical traces of the substrate 62 in accordance with any suitable alternative embodiment. For instance, the mounting portions can be surface mounted and configured to be fused, for instance soldered, to complementary contact pads of the substrate 62.

Each contact body 70 of the electrical contacts 64, and thus each electrical contact 64, can further define an intermediate portion 67 that extends between the mating portion 66 and the opposed press-fit tail. Each leadframe assembly 60, and thus the respective electrical contacts 64 of each leadframe assembly 60, can be arranged in respective columns C that extend along the transverse direction T, and can be spaced from the other leadframe assemblies 60 along the lateral direction A, which can define a row direction. The columns C can be oriented substantially perpendicular to the upper surface of the substrate 62 to which the first electrical connector 42 is mounted. The mounting portions 68 of the electrical contacts 64 of each respective leadframe assembly 60 are spaced substantially along the longitudinal direction L and extend downward from the respective leadframe housing 74 along the transverse direction T. The mating portions 66 of each respective leadframe assembly 60 are spaced along the transverse direction T and extend forward from the respective leadframe housing 74 along the longitudinal direction L that is substantially perpendicular to the transverse direction T. Thus, it can be said that the mating portions 66 extend along a first or mating direction relative to the respective leadframe housing 74, while the mounting portions 68 extend along a second direction relative to the leadframe housing 74 that is substantially perpendicular to the first direction. The electrical connector 42, for instance the leadframe assemblies 60, can include a dielectric material, such as air or plastic, that electrically isolates individual ones of the electrical contacts 64 from one another.

At least one up to all of the electrical contacts 64 can define signal contacts 95 and at least one such as a plurality of the electrical contacts 64 can define ground contacts 97 that can be disposed between adjacent signal contacts 95. For instance, adjacent signal contacts 95 of each row that are spaced along the lateral direction A can define a differential signal pair, and the ground contacts 97 can be disposed between adjacent differential signal pairs along the row, or can be otherwise disposed as desired. Thus, the electrical contacts 64 can define a repeating S-S-G pattern, G-S-S pattern, S-G-S along the lateral direction A in the respective row, or can define any other pattern as desired, wherein "S" identifies a signal contact 95 and "G" identifies a ground contact 97.

The first electrical contacts 64 can define receptacle type mating portions 66. Because the mating portions 66 of the electrical contacts 64 are configured as receptacle type mating portions, the first electrical connector 42 can be referred to as a receptacle connector. Furthermore, because the first mating interface 50 is oriented substantially perpendicular to the first mounting interface 52, the first electrical connector 42 can be referred to as a right angle connector, though it should be appreciated that the electrical connector 42 can alternatively be constructed in accordance with any desired configuration so as to electrically connect an underlying substrate 62, such as a printed circuit board, to a complementary electrical connector, such as the illustrated complementary electrical connector 44. For instance, the first electrical connector 42 can alternatively be constructed as a plug or header type connector with electrical contacts 64 having spade, or plug type mating ends configured to be plugged into, or received by complementary receptacle type mating ends of the electrical contacts of a complementary electrical connector, such as a vertical connector or a right-angle connector, that is to be mated to the electrical connector 42. Additionally, the electrical connector 42 can be configured as a vertical connector, whereby the mating interface 50 is oriented substantially parallel with respect to the mounting interface 52.

Referring to FIGS. 3-4, the complementary electrical contacts 53 of the complementary electrical connector 44 can define respective second or complementary mating portions 54 that are disposed proximate to the complementary mating interface 46, and are configured to be electrically mated to an electrical component, such as the first electrical connector 42. The mating portions 54 can be elongate along the mating direction M that is parallel to the mounting direction of the complementary electrical connector 44. The electrical contacts 53 can further define respective second or complementary mounting portions 56 that can be configured as mounting tails, such as press-fit tails, that are disposed proximate to the mounting interface 48 and can be configured to be mounted to the complementary underlying substrate 58. For instance, the mounting portions 56 can be press-fit tails and can be configured to be inserted, or press-fit, into respective vias of the substrate 58, thereby electrically connecting the mounting portions 56 and the corresponding electrical contacts 53 to respective electrical traces of the substrate 58 when the complementary electrical connector 44 is mounted to the substrate 58. The mounting portions 56 can be elongate along the longitudinal direction L and can be elongate along substantially the same direction as the mating portions 54. While the mounting portions 56 of the electrical contacts 53 are configured as press-fit tails, it should be appreciated that the mounting portions can be configured to be placed in electrical communication with electrical traces of the substrate 58 in accordance with any suitable alternative embodiment. For instance, the mounting portions can be surface mounted and configured to be fused, for instance soldered, to complementary contact pads of the substrate 58.

Figure 7A:
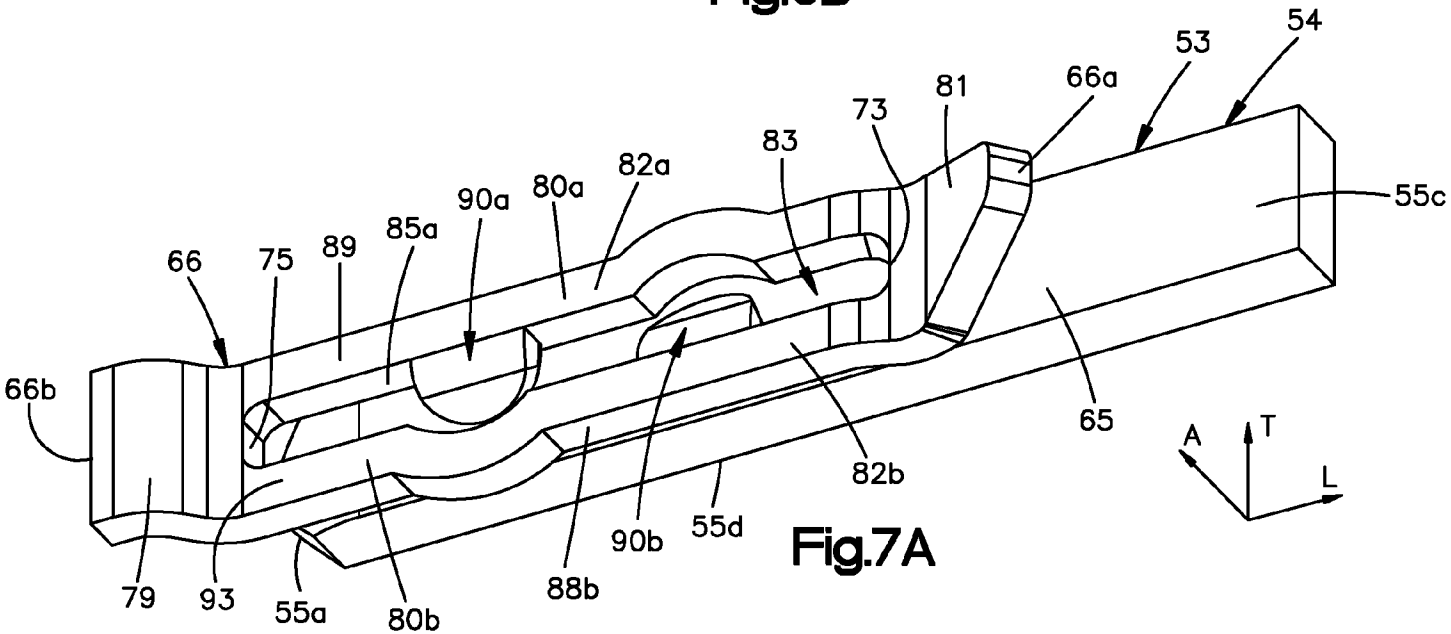
FIG. 7A is a perspective view of a portion of the electrical connector system, showing the mating portion illustrated in FIG. 6A in a mated position with a mating portion of a complementary electrical contact of the header connector in accordance with an embodiment.
Figure 7B:
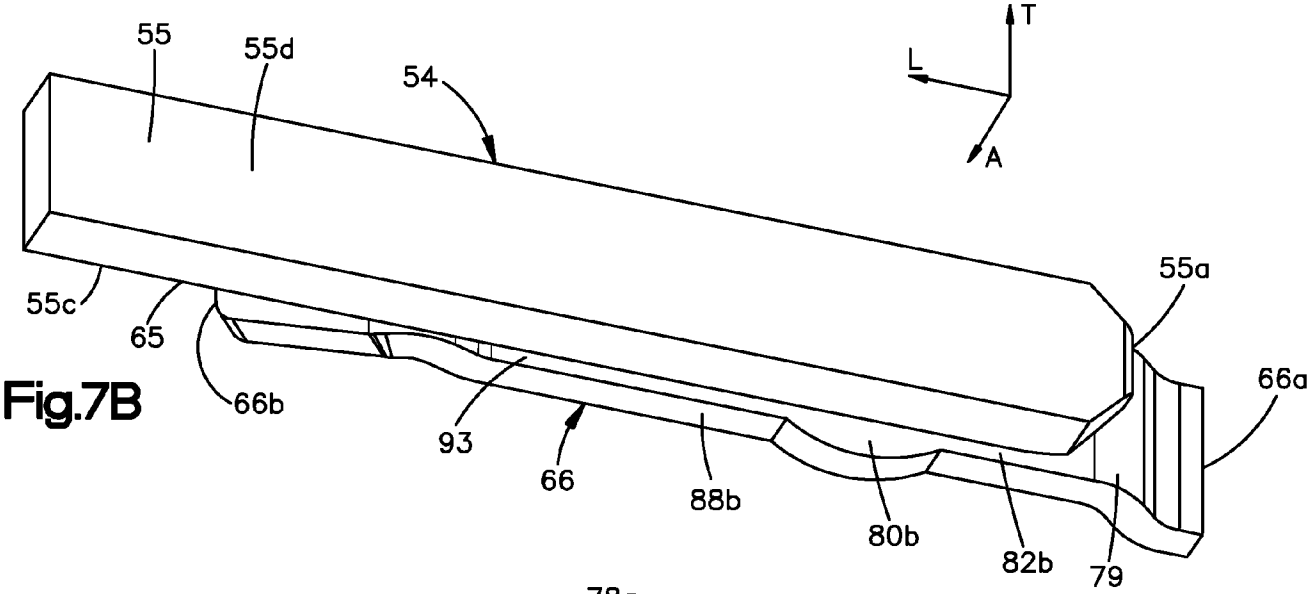
FIG. 7B is another perspective view of a portion of the electrical connector system, showing the mating portion illustrated in FIG. 6A in a mated position with a mating portion of a complementary electrical contact of the header connector in accordance with the embodiment illustrated in FIG. 7A.

Referring also to FIGS. 7A-B, in accordance with the illustrated embodiment, the respective complementary mating portions 54 of the complementary electrical contacts 53 are configured as plugs that are configured to be received by the respective first mating portions 66 of the electrical contacts 64 of the first electrical connector 42 when the first and complementary electrical connectors 42 and 44 are mated, thereby establishing an electrical connection between the first and complementary electrical connectors 42 and 44, respectively. Thus, the mating portions 66 are configured to mate with respective mating portions 54 of the complementary electrical contacts 53. For instance, each of the electrical contacts 53 can include a second or complementary contact body 55 that includes a front end 55*a* and an opposed rear end 55*b* that is disposed proximate to the complementary mounting portion 56 and is spaced from the front end 55*a* along the longitudinal direction L. The complementary contact body 55 can further include a first side 55*c* and a second side 55*d* that is spaced apart from the first side 55*c* along the lateral direction A that is substantially perpendicular to the mating direction M. The first side 55*c* can define a contact surface 65 that is configured to abut at least a portion of a first electrical contact 64 so as to place the complementary electrical connector 44 in electrical communication with the first electrical connector 42 when the electrical connectors 42 and 44 are mated with each other. The mating portion 54 of the second electrical contact 53 can define the contact surface 65 that is in contact with the at least one contact surface of the first electrical connector 42 when the first electrical connector 42 is mated with the second electrical connector 44. The first and second sides 55*c* and 55*d*, respectively, can generally lie in a plane defined by the longitudinal and transverse directions L and T, respectively. While the lateral and longitudinal directions A and L, respectively, extend horizontally and the transverse direction T extends vertically in accordance with the illustrated orientation of the electrical connector system 40, it should be appreciated that the orientation of the electrical connector system can vary as desired.

Because the mating portions 54 of the electrical contacts 53 are configured as plug or header type mating portions, the complementary electrical connector 44 can be referred to as a header connector. Furthermore, because the complementary mating interface 46 is oriented substantially parallel to the complementary mounting interface 48, the complementary electrical connector 44 can be referred to as a vertical connector, though it should be appreciated that the electrical connector 44 can alternatively be constructed in accordance with any desired configuration so as to electrically connect an underlying substrate 58, such as a printed circuit board, to another electrical connector, such as the illustrated first electrical connector 42. For instance, the complementary electrical connector 44 can alternatively be constructed as a receptacle type connector with electrical contacts 53 having receptacle type mating ends configured to receive space or plug type mating ends of an electrical connector that is to be mated with the electrical connector 44. Additionally, the electrical connector 44 can be configured as a right-angle connector, whereby the mating interface 46 is oriented substantially perpendicular with respect to the mounting interface 48.

Figure 6A:
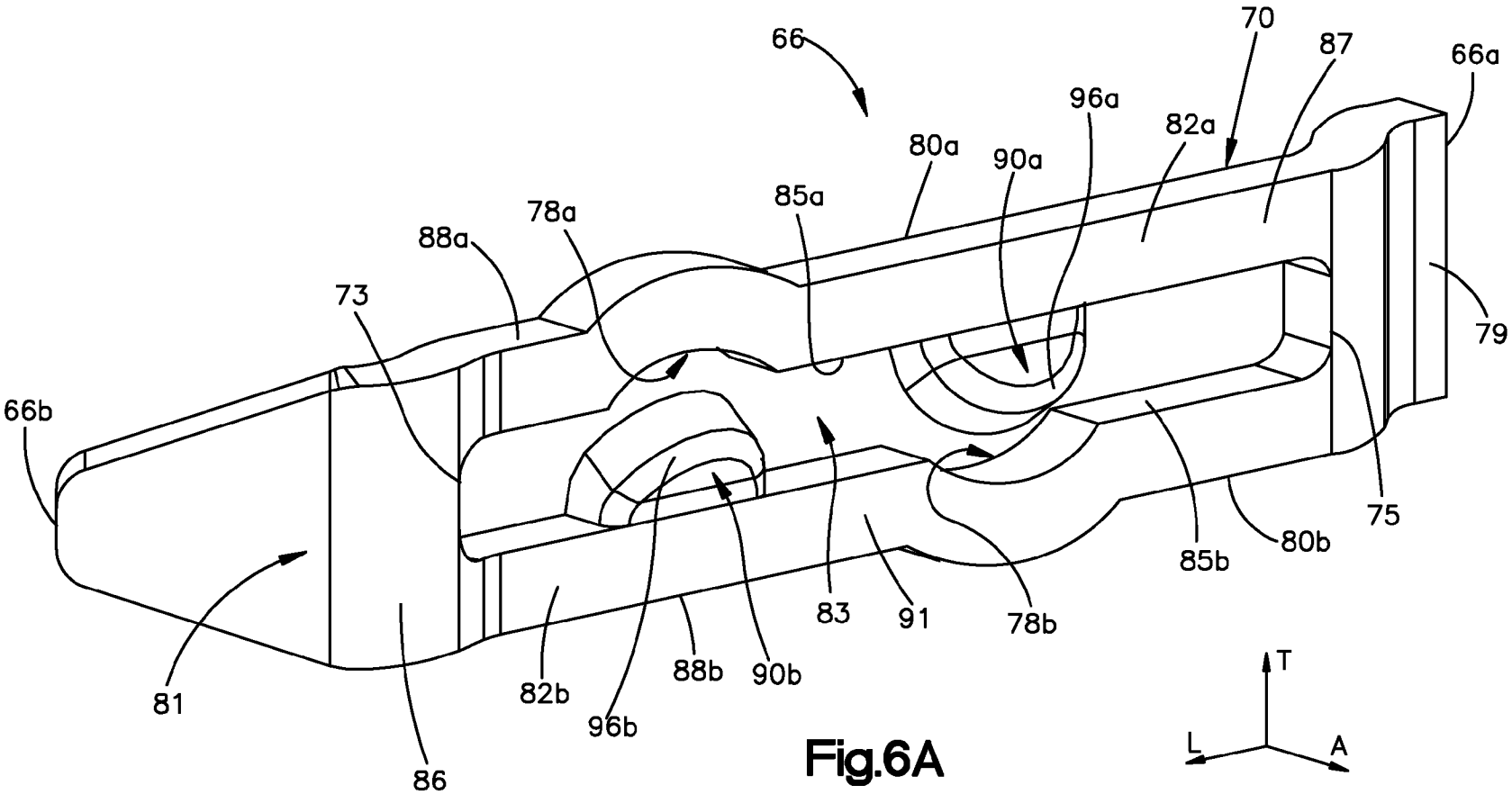
FIG. 6A is a perspective view of a mating portion of an electrical receptacle contact in accordance with one embodiment, showing the mating portion of the electrical contact as illustrated in FIG. 5.
Figure 6B:
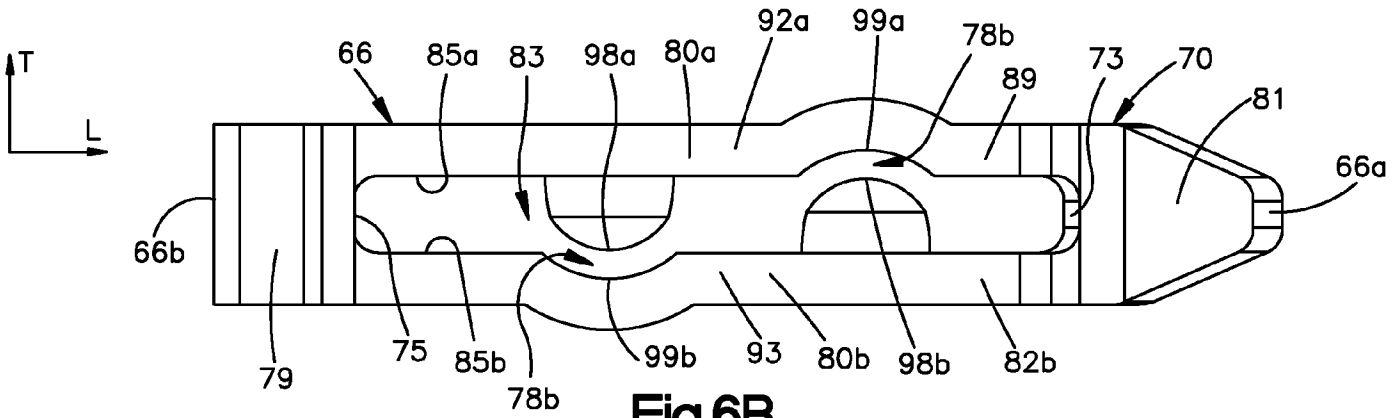
FIG. 6B is a side elevation view of the mating portion illustrated in FIG. 6A.

Referring now to FIGS. 5-6B, the electrical contacts 64 can include a respective contact body 70 that defines the mating portion 66, the mounting portion 68, and the intermediate portion 67 that is configured to be supported by the leadframe housing 74 and extends between the mating portion 66 and the mounting portion 68. The intermediate portions 67 of the electrical contacts 64 can be curved as illustrated, but the contact bodies 70 are not limited to this geometry, and it should be appreciated that the intermediate portions 67 can alternatively be constructed defining any other geometry as desired. The respective mating portions 66 of the electrical contacts 64 can be configured to contact respective complementary mating portions 54 of the complementary electrical contacts 53 when the first and complementary electrical connectors 42 and 44, respectively, are mated along the mating direction M. Thus, an electrical contact 64 can be configured to mate with a complementary electrical contact 53 of the second electrical connector 44 along the mating direction M that can be the longitudinal direction L. More specifically, the mating portions 66 of the electrical contacts 64 can be constructed to engage the blade-type, or plug-type complementary mating portions 54 of the complementary electrical contacts 53. It should be appreciated that the mating portion 66 can be included in a right-angle electrical contact as illustrated, or a vertical receptacle electrical contact as desired.

The mating portion 66, and thus the contact body 70, can define a proximal end 66*a* that extends from the intermediate portion 67 along the longitudinal direction L, and a free distal end 66*b* that is spaced from the proximal end 66*a* along the mating direction M, which can be forward along the longitudinal direction L. In accordance with the illustrated embodiment, the distal end 66*b* can be disposed proximate to the mating interface 50 and can terminate at a first location that is spaced from the rear end 71*b* a first distance along the mating direction M, and the proximal end 66*a* can also be disposed proximate to the mating interface 50 and can terminate at a second location that is spaced from the rear end 71*b* a second distance along the mating direction M that is shorter than the first distance. It should be appreciated that the direction terms "distal" and "forward" and derivatives can refer to a direction along the longitudinal direction L from the proximal end 66*a* of the mating portion 66 toward the distal end 66*b* of the mating portion 66. It should further be appreciated that the direction terms "proximal" and "rearward" and derivatives thereof can refer to a direction along the longitudinal direction L from the distal end 66*b* of the mating portion 66 toward the proximal end 66*a* of the mating portion 66.

With continuing reference to FIGS. 5-6B, the mating portions 66 of at least one, such as all of the electrical contacts 64 can define a first or upper contact beam 80*a* that extends between the proximal end 66*a* and the distal end 66*b* along the mating direction M, and a second or lower contact beam 80*b* that extends between the proximal end 66*a* and the distal end 66*b* along the mating direction M. The second contact beam 80*b* can be spaced from the first contact beam 80*a* along the transverse direction T that is substantially perpendicular to the longitudinal direction L which can be the mating direction M. Thus, the mating portion 66 can define a gap 83 that is defined between the first and second contact beams 80*a* and 80*b*, respectively, along the transverse direction T. The mating portion 66 can further include a first or front end wall 73 that is disposed proximate to the distal end 66*b* and extends from the first contact beam 80*a* to the second contact beam 80*b*, and a second or rear end wall 75 that is disposed proximate to the proximal end 66*a* and also extends from the first contact beam 80*a* to the lower contact beam 80*b*. In accordance with the illustrated embodiment, the front end wall 73 and the rear end wall 75 are spaced apart from each other along the mating direction M. Thus, it can be said that the front end wall 73 extends between the front ends of the first and second contact beams 80*a* and 80*b*, respectively, and the rear end wall 75 extends between the rear ends of the first and second contact beams 80*a* and 80*b*, respectively. And it can be said the first and second contact beams 80*a* and 80*b*, respectively, extend between the front and rear end walls 73 and 75, respectively, along the mating direction M. More specifically, the first contact beam 80*a* can include a first beam body 82*a* that extends from the front end wall 73 of the mating portion 66 to the rear end wall 75 of the mating portion 66, and the second contact beam 80*b* can include a second beam body 82*b* that also extends from the front end wall 73 to the rear end wall 75. Thus, the first and second beam bodies 82*a* and 82*b* can define substantially the same length as each other along the mating direction M. The first beam body 82*a* can be spaced from the second beam body 82*b* along the transverse direction T that is substantially perpendicular to the mating direction M so as to at least partially define the gap 83 between the first beam body 82*a* and the second beam body 82*b* along the transverse direction T. Further, it can be said the beam bodies 82*a* and 82*b*, respectively, and the front and rear end walls define the gap 83. Thus, the first and second contact beams 80*a* and 80*b*, and the front and rear end walls 73 and 75, can at least partially define an outer perimeter of the gap 83. It can therefore be said that the electrical contact 64 defines an open or split mating portion 66, and the mating portion 66 defines a gap between the inner surfaces of the first and second contact beams 80*a* and 80*b*, respectively.

Referring also to FIGS. 7A-F, the first and second contact beams 80*a* and 80*b*, respectively, can define a first beam body 82*a* and a second beam body 82*b*, respectively. The first beam body 82*a* can include a first inner surface 85*a*, and the second beam body 82*b* can include a second inner surface 85*b* such that the inner surfaces 85*a* and 85*b* face each other and extend from the front end wall 73 to the rear end wall 75 along the mating direction M which can be the longitudinal direction L. Thus, each of the first and second contact beams 80*a* and 80*b*, respectively, can define an inner surface that faces the inner surface of the other of the first and second beams 80*a* and 80*b*, respectively. Further, it can be said that the second inner surface 85*b* faces the first inner surface 85*a* to at least partially define the gap 83 between the first and second inner surfaces 85*a* and 85*b*, respectively. The first beam body 82*a* can further define a first outer surface 88*a* that is spaced apart upward from the first inner surface 85*a* along the transverse direction T, a first side 87, and an second side 89 that is spaced apart from the first side 87 along the lateral direction A, such that the first inner surface 85*a* extends between the first and second sides 87 and 89, respectively, of the first beam body 82*a*. Similarly, the second beam body 82*b* can further define a second outer surface 88*b* that is spaced downward from the second inner surface 85*b* along the transverse direction T, a first side 91, and a second side 93 that is spaced apart from the first side 91 along the lateral direction A, such that the second inner surface 85*b* extends between the first and second sides 91 and 93, respectively, of the second beam body 82*b*. The upper first side 87 and the lower first side 91 can lie in substantially the same plane that can generally be defined by the transverse and longitudinal directions T and L, respectively, and the longitudinal direction can be mating direction M. Thus, the first sides 87 and 91 of the first and second contact beams 80*a* and 80*b*, respectively, can extend along an offset plane P (see FIG. 7F) that can be defined by the mating direction M and the transverse direction T. Further, the offset plane P can be substantially perpendicular to the plane defined by the first mounting interface 52 and the plane defined by the first mating interface 50 in accordance with the illustrated embodiment.

Each of the mating portions 66, and thus each of the electrical contacts 64, can define a tip 81 that can extend between the distal end 66*b* of the mating portion 66 and the front end wall 73. The tip 81 can extend distally from the first and second contact beams 80*a* and 80*b*, respectively. Thus, the tip 81 can define a free end of the mating portion 66. The mating portions 66 can further define a neck 79 that can extend between the rear end wall 75 and the proximal end 66*a* of the mating portion 66. The neck 79 can be curved along the lateral direction A such that the contact beams 80*a* and 80*b* can be offset from the intermediate portion 67 along the lateral direction A. In accordance with the illustrated embodiment, the contact beams 80*a* and 80*b* are offset laterally outward with respect to the intermediate portion 67. Thus, first sides 87 and 91 that can extend along the offset plane P can be offset in a lateral direction A with respect to the intermediate portion 67.

Referring to FIGS. 6A-8, in accordance with the illustrated embodiment, the first contact beam 80*a* can further include the first beam body 82*a* and a first contact member 90*a* that extends from the first beam body 82*a* along the transverse direction T and along the lateral direction A that is substantially perpendicular to both the second direction and the first mating direction M, such that at least a portion of the first contact member 90*a* is configured to make contact with a complementary electrical contact 53 when the electrical connector 42 is mated with the complementary electrical connector 44. Similarly, the second contact beam 80*b*, and thus the electrical contact 64, can further include a second beam body 82*b* and an second contact member 90*b* that extends from the second beam body 82*b* along the transverse direction T and along the lateral direction A that is substantially perpendicular to both the transverse direction T and the mating direction M, such that the at least a portion of the second contact member 90*b* is configured to make contact with a complementary electrical contact 53 when the electrical connector 42 is mated with the complementary electrical connector 44. Thus, it can be said that at least one of the first and second contact beams 80*a* and 80*b* can include a beam body and a contact member that extends from the beam body along a second direction and the third direction that is substantially perpendicular to both the mating and second directions, such that at least a portion of a contact member is configured to make contact with the complementary electrical contact 53 of the complementary electrical connector 44 when the first electrical connector 42 is mated with the complementary electrical connector 44. It can further be said that, when viewed along the lateral direction A that is perpendicular to the mating direction M and the transverse direction T, at one least one of the first and second contact beams 80*a* and 80*b* can include at least one contact member that extends from the respective beam body into the gap 83 toward the other beam body along the transverse direction T.

It will be understood that at least one of the contact members can be constructed to extend into the gap 83. Thus, at least one contact member can project out from the respective beam body along the transverse direction T. In accordance with the illustrated embodiment, each of the first and second contact beams 80*a* and 80*b*, respectively, include at least one contact member that extends from the respective beam body into the gap toward the other beam body along the transverse direction T. Further, the contact members 90*a* and 90*b* can be integral and monolithic with the respective contact beams 80*a* and 80*b*. Alternatively, the contact members 90*a* and 90*b* can be provided as a separate component that can be affixed to the respective contact beams 80*a* and 80*b*, and thus to the mating portion 66 of the electrical contact 64.

In accordance with the illustrated embodiment, at least one first contact member 90*a* can extend from the first inner surface 85*a* of the first beam body 82*a* along the transverse and lateral directions T and A, respectively, and at least one second contact member 90*b* can extend from the second inner surface 85*b* of the second beam body 82*b* along the transverse and lateral directions T and A, respectively, although it should be appreciated that the number of contact members and the surfaces that they extend from can vary as desired. Thus, it can be said that an electrical contact 64 can include a first contact member 90*a* that extends from the inner surface 85*a* of the first contact beam 80*a*, and a second contact member 90*b* that extends from the inner surface 85*b* of the second contact beam 80*b* along a direction toward the first contact beam 80*a*, the second contact member 90*b* defining a second or lower contact surface 96*b* configured to contact the complementary electrical contact 53 when the electrical contact 64 is mated with the complementary electrical contact 53. It can further be said that at least one contact member can extend from the inner surface of at least one of the first and second contact beams 80*a* and 80*b*, respectively, along a direction that has a directional component toward the other of the first and second contact beams and along the lateral direction A that extends outward. Thus, the contact members can define at least one respective side surface, such as opposed side surfaces, having at least a respective portion that lies in a corresponding plane defined by the longitudinal direction L and a second direction that is angularly offset with respect to the transverse direction T and the lateral direction A that is substantially perpendicular to both the transverse and longitudinal directions T and L, respectively.

In the illustrated embodiment, the second contact member 90*b* is spaced from the first contact member 90*a* along the longitudinal direction L which can be the mating direction M, and the second contact member 90*b* is disposed closer to the distal end 66*b* along the longitudinal direction L than the first contact member 90*a*, although it should be appreciated that the location of the contact members can vary as desired, for instance one or more first contact members 90*a* can be disposed closer to the distal end 66*b* along the longitudinal direction L than one or more second contact members 90*b*. For instance, the second contact member 90*b* can be spaced longitudinally rearward or proximal from the first contact member 90*a* as illustrated, or can alternatively be spaced longitudinally forward or distal from the first contact member 90*a*.

Still referring to FIGS. 6A-8, the first contact members 90*a* can define respective first or upper contact surfaces 96*a* and second contact members 90*b* can define respective second or lower contact surfaces 96*b*. Thus, at least one contact member can define a contact surface that is configured to contact the complementary electrical contact 53 when the electrical contact 64 is mated with the complementary electrical contact 53. At least one of the first and second contact surfaces 96*a* and 96*b*, respectively, can be aligned with the gap 83 along the lateral direction A that is substantially perpendicular with respect to both the longitudinal and transverse directions L and T, respectively. When the electrical contact 64 is viewed along the transverse direction T, each of the first and second contact surfaces 96*a* and 96*b* can be arc-shaped and can define an apex that is spaced from the respective first side along the lateral direction A and configured to abut the complementary electrical contact 53 of the complementary electrical connector 44 when the electrical connector 42 is mated with the complementary electrical connector 44.

For instance, the first contact surfaces 96*a* can be arc-shaped and can each define a respective first apex 98*a* that is disposed closer to the first side 87 than the second side 89 along the lateral direction A. Thus, the apex 98*a* of the first contact surface 96*a* can be spaced from the offset plane P in the lateral direction A a first offset distance D1. Similarly, the second contact surfaces 96*b* can be arc-shaped and can each define a respective second apex 98*b* that is disposed closer to the first side 91 than the second side 83 along the lateral direction A. Thus, the apex 98*b* of the second contact surface 96*b* can be spaced from the offset plane P in the lateral direction A a second offset distance D2 that is substantially equal to the first offset distance D1. Thus, it can be said that each apex can be disposed closer to the respective first side than the respective second side along the lateral direction A. The first offset distance D1 can be substantially equal to the second offset distance D2 such that a single complementary electrical contact 53 can be configured to contact both first and second contact surfaces 96*a* and 96*b* when the complementary electrical connector 44 is mated with the first electrical connector 42. Although the illustrated embodiments show each contact member constructed to include an arc-shaped contact surface, it will be understood that the contact members, and thus the contact surface, can be constructed in any suitable geometry as desired, and any number of contact surfaces can be configured to abut a complementary electrical contact as desired.

Figure 7C:
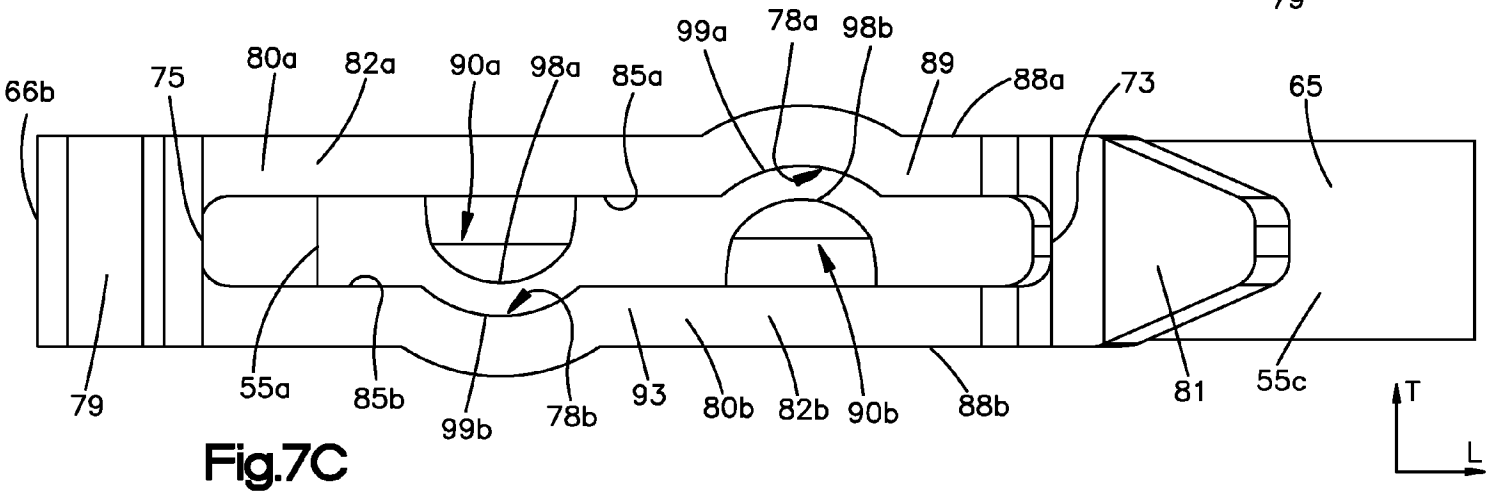
FIG. 7C is a side elevation view of a portion of the electrical connector system, showing the mating portion illustrated in FIG. 6A in a mated position with a mating portion of a complementary electrical contact of the header connector in accordance with the embodiment illustrated in FIG. 7A.

Referring to FIGS. 6A-B and 7C, the mating portion 66 can define a first recess 78*a* in the inner surface 85*a* of the first contact beam 80*a*. The recess 78*a* can be aligned with the second contact member 90*b* along the transverse direction T, such that the second contact member 90*b*, including the contact surface 96*b*, is spaced from the first contact beam 80*a*. For instance, the first recess 78*a* can be arc-shaped and can define a first recess apex 99*a* along the transverse direction T such that the first recess apex 99*a* is substantially aligned with the second apex 98*b* of the second contact member 90*b* along the mating direction M. Similarly, the mating portion 66 can define a second recess 78*b* in the inner surface 85*b* of the second contact beam 80*b*. The recess 78*b* can be aligned with the first contact member 90*a* along the transverse direction T, such that the first contact member 90*a*, including the contact surface 96*a*, is spaced from the second contact beam 80*b*. For instance, the second recess 78*b* can be arc-shaped and can define a second recess apex 99*b* along the transverse direction T such that the second recess apex 99*b* is substantially aligned with the first apex 98*a* of the first contact member 90*a* along the mating direction M. Although the recesses 78*a* and 78*b* are illustrated as arc-shaped, the recess can be constructed in any suitable geometry as desired. Further, the beam bodies 82*a* and 82*b* can define respective heights that can be defined as the distance between their respective inner surfaces 85*a* and 85*b* and their respective outer surfaces 88*a* and 88*b* along the transverse direction T. As illustrated, the outer surfaces 88*a* and 88*b* of the respective beam bodies 82*a* and 82*b* can define a shape, for instance a curved arch, that corresponds to the shape of the respective recesses 78*a* and 78*b* so that the height of each of the beam bodies 82*a* and 82*b* can be equivalent along the mounting direction M from the front end wall 73 to the rear end wall 75.

Figure 7D:
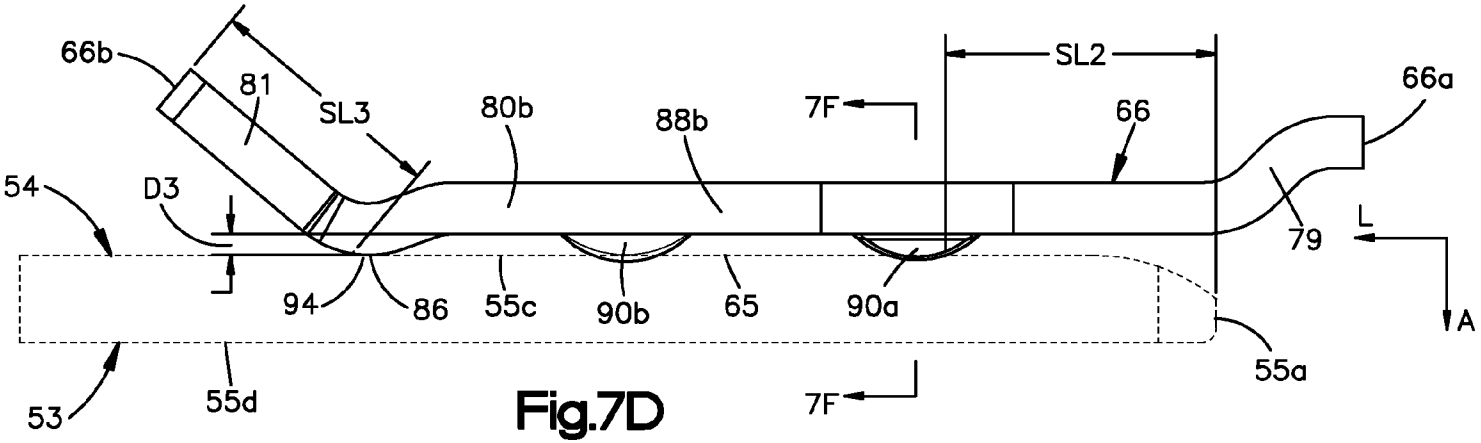
FIG. 7D is a bottom plan view of a portion of the electrical connector system, showing the mating portion illustrated in FIG. 6A in a mated position with a mating portion of a complementary electrical contact of the header connector in accordance with the embodiment illustrated in FIG. 7A.
Figure 7E:
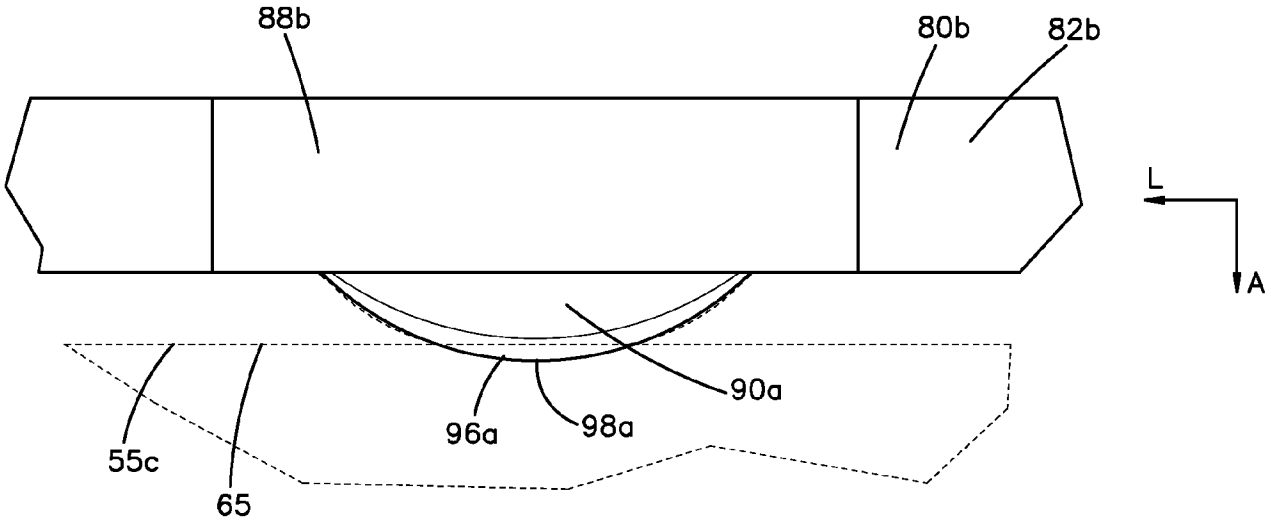
FIG. 7E is an isolated view of the bottom plan view of FIG. 7D, showing a contact member of the mating portion illustrated in FIG. 6A in a mated position with a portion of the mating portion of a complementary electrical contact of the header connector in accordance with the embodiment illustrated in FIG. 7A.
Figure 7F:
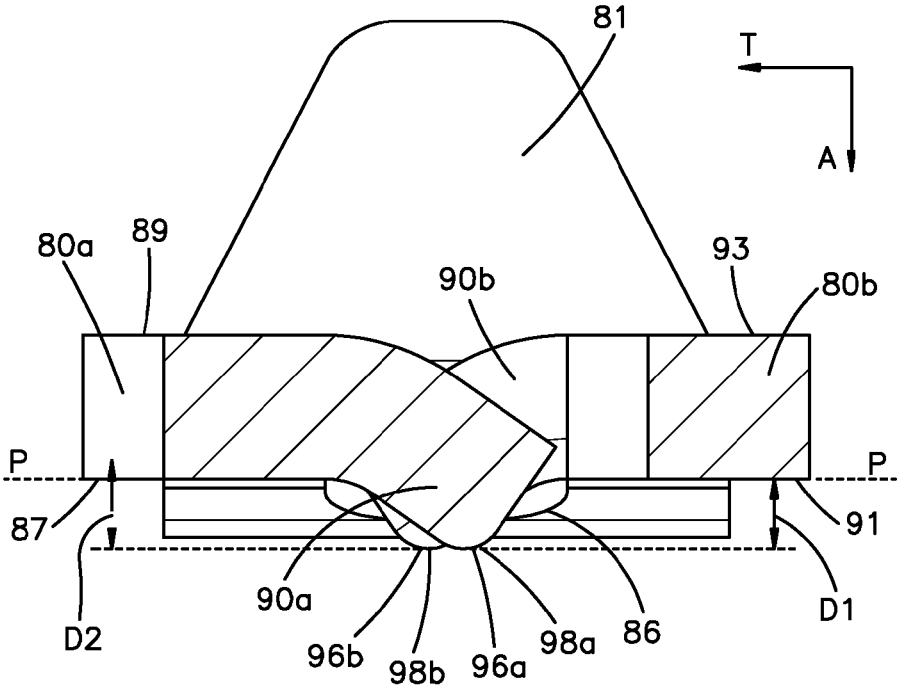
FIG. 7F is a sectional rear elevation view of the portion of the electrical connector system illustrated in FIG. 7D but without showing the complementary electrical contact of the header connector.
Figure 8:
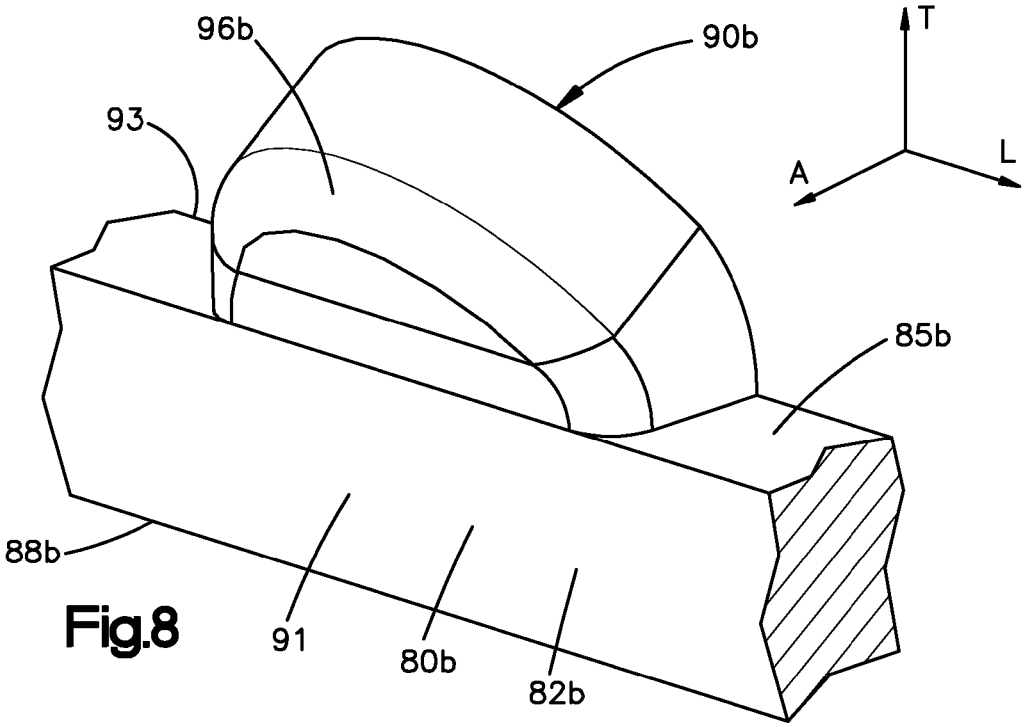
FIG. 8 is an isolated perspective view of a contact member of the mating portion shown in FIG. 6A.

Referring to FIGS. 6A, 7D, and 7F, the tip 81 can be constructed to define a third or tip contact surface 86 that can be curved and can be configured to contact a complementary electrical contact 53 when the electrical contact 64, and thus the electrical connector 42, is mated with the complementary electrical contact 53, and thus the complementary electrical connector 44. The tip contact surface 86 can be arc-shaped and can define a third or tip apex 94 that is spaced from the offset plane P in the lateral direction A, such that the tip apex 94, and thus the tip contact surface 86, is configured to contact a complementary contact 53 of the complementary electrical connector 44 when the electrical connector 42 is mated with the complementary electrical connector 44. Thus, the contact surface 86 of the tip 81 can be substantially aligned with the contact surfaces defined by the first and second contact members 90*a* and 90*b*, respectively, along the longitudinal direction L. The tip apex 94 can be offset in the lateral direction A a third offset distance D3 (see FIG. 7D) from the offset plane P. In accordance with the illustrated embodiment, the third offset distance D3 can be no greater than, for instance less than, the first offset distance D1 and the second offset distance D2. The tip 81 can be curved such that the tip contact surface 86 is substantially aligned with the first and second contact surfaces 96*a* and 96*b* when viewed along the longitudinal direction L, while the distal end 66*b* of the mating portion 66 extends in a lateral inward direction from the front end wall 73.

In operation, the first electrical connector assembly 41 can be mated to the complementary electrical connector assembly 43 along the mating direction M (see FIGS. 2-3) so that the front ends 55*a* of the complementary contacts 53 move from the distal ends 66*b* of the electrical contacts 64 toward the proximal ends 66*a* of the electrical contacts 64 as the electrical connectors 42 and 44 are mated with each other. Thus, as the first electrical connector 42 is mated to the complementary electrical connector 44 along the mating direction M, the mating portions 54 of the electrical contacts 53 of the complementary electrical connector 44 are brought into contact, and thus electrical communication with, the respective mating portions 66 of electrical contacts 64 of the first electrical connector 42. More specifically, as the complementary mating portions 54 come into contact with the first mating portions 66, the contact surfaces 86 of the tips 81 of the electrical contacts 64 ride along the mating portions 54 of the electrical contacts 53. In accordance with the illustrated embodiment, as the mating portions 66 further advance with respect to the mating portions 54 along the mating direction M, the respective second contact surfaces 96*b* of the second contact members 90*b* are brought into contact with the respective contact surfaces 65 of the complementary mating portions 54. As the first mating portions 66 further advance with respect to the complementary mating portions 54 along the mating direction M, the respective first contact surfaces 96*a* of the first contact members 90*a* are brought into contact with the respective contact surfaces 65 of the mating portions 54 in accordance with the illustrated embodiment.

Thus, it should be appreciated that the first contact member 90*a* can define the first contact surface 96*a* and the second contact member 90*b* can define the second contact surface 96*b*, such that each of contact surfaces can be configured to move along the complementary electrical contact 53 in the mating direction M as the electrical connector 42 is mated with the complementary electrical connector 44. Further, it can be said that the mating portion 66 of each electrical contact 64 can define at least two or more, such as three for instance, contact surfaces that are configured to contact the mating portion 54 as the first and second electrical connectors 42 and 44 are mated. It should be appreciated that although the first contact surfaces 96*a* of the first contact members 90*a* will be the final contact surfaces to make contact with the complementary electrical contacts 53 during a mating operation according to the illustrated embodiment, the electrical contacts 64 can be constructed so as to allow the first contact surfaces 96*a* to make contact with the complementary electrical contacts 53 before the second contact surfaces 96*b* make contact with the complementary electrical contacts 53 during a mating operation. For instance, the electrical contacts 64 are not limited to the illustrated embodiment, and thus the mating portion 66 can be constructed with the first contact members 90*a* disposed at a location proximate to the distal end 66*b* of the mating portion 66 along the mating direction M, while the second contact members 90*b* can be disposed proximate to the proximal end 66*a* along the mating direction M.

It should be appreciated that as the first mating portions 66 advance with respect to the complementary mating portions 54 along the mating direction M, one or both of the mating portions 54 and 66 can deflect laterally outward away from the other of the mating portions 54 and 66, which can cause normal forces opposite the deflection to accumulate in the respective mating portion. Thus, when the complementary electrical connector 44 is in a mated position with the electrical connector 42 (see FIG. 7D), the mating portions 66 of the electrical contacts 64 can define a normal force such that the contact surfaces 65 of the complementary electrical contact 53 are biased toward the contact surfaces 86, 96*a*, and 96*b* of the electrical contacts 64. The normal forces can thus bias the mating portions 54 and 66 toward each other so as to maintain the contact between the contact surfaces of the mating portions 66 of the electrical contacts 64 with the mating portions 54 of the electrical contacts 53. It should be appreciated that generation of the bias is not limited to the geometries and properties of the mating portions 54 and 66, and that contact between the mating portions 54 and 66 can be generated due to other characteristics of the electrical connector system 40.

Referring to FIG. 7D, when the electrical connector 42 is in a mated position with the complementary electrical connector 44, it can be said that the complementary mating portion 54, and thus the complementary contact 53, terminates at a third location along the mating direction M. More specifically, the front end 55*a* of the complementary contact 53 can terminate at the third location when the electrical connectors 42 and 44 are fully mated with each other. Further, when the electrical connector 42 is in a mated position with the complementary connector 44, the first and complementary mating portions 66 and 54, respectively, can define a second stub length SL2. In accordance with the illustrated embodiment, the mating portion 66 of the first electrical contact 64 can define the second stub length SL2 between the contact surface 96*a* of the mating portion 66 of the first electrical contact 64 and a terminal end of the second electrical contact 53, such that the stub length SL2 can be greater than zero and less than 2 mm. Stated another way, the stub length SL2 can be defined as the distance between the third location in which the front end 55*a* terminates along the longitudinal direction L, and the location on the contact surface 65 at which the first contact surface 96*a* makes contact with the contact surface 65 when the mating portion 54 of the complementary electrical contact 53 is mated with the mating portion 66 of the first electrical contact 64. Thus, the stub length SL2 can be defined as the distance between the first apex 98*a* and the third location in which the mating portion 54 terminates along the longitudinal direction when the complementary contact 53 is in a mated position with the electrical contact 64. It will be understood that the stub length SL2 is not only defined by the illustrated embodiment, and thus can also be defined by the distance between the second apex 98*b* and the front end 55*a*, for instance when the second contact member 90*b* is disposed closer to the proximal end 66*a* along the longitudinal direction L than the first contact member 90*a*. The second stub length SL2 can be less than the first stub length SL1 (see FIG. 1) while ensuring that a sufficient normal force biases the mating portions 54 and 66 together at the respective contact surfaces. The stub length SL2 can be greater than zero and less than 2 mm, for instance about 1 mm or less, wherein less is a length greater than zero. It will be appreciated that the mating portions can be constructed to define other stub lengths as desired.

Referring to FIG. 7D, the mating portions 66 can each define a third stub length SL3 that can be defined as the length of the mating portion 66 between the contact surface, of the mating portion 66, that is closest to the distal end 66*b* along the longitudinal direction L, and the distal end 66*b*. Thus, in accordance with the illustrated embodiment, the third stub length SL3 can be defined as the length of the mating portion 66 between the tip contact surface 86 and the terminal distal end 66*b*. The stub length SL3 can be in a positive length range of about 1 mm to 2 mm, or less than 1 mm wherein less is a positive length greater than zero and less than 2 mm, or alternatively more than 2 mm.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. Those skilled in the relevant art, having the benefit of the teachings of this specification, may effect numerous modifications to the invention as described herein, and changes may be made without departing from the spirit and scope of the invention, for instance as set forth by the appended claims.

What is claimed:

1. An electrical contact configured to mate with a complementary electrical contact of a second electrical connector along a longitudinal direction, the electrical contact comprising:

a mounting portion configured to electrically connect to a substrate, a mating portion configured to mate with mating portions of the complementary electrical contact, and an intermediate portion that is configured to be supported by a connector housing and extends between the mating portion and the mounting portion, wherein the mating portion includes 1) first and second contact beams spaced from each other along a transverse direction that is substantially perpendicular to the longitudinal direction, 2) first and second sides that are defined by the first and second contact beams and are opposite each other along a lateral direction that is perpendicular to both the transverse direction and the longitudinal direction, each of the first and second contact beams further defining an inner surface that faces the inner surface of the other of the first and second contact beams, and 3) at least one contact member that extends from the inner surface of at least one of the first and second contact beams along a direction that has a first directional component toward the other of the first and second contact beams, and a second directional component in the lateral direction such that the at least one contact member projects away from each of the first and second sides, such that the at least one contact member defines a contact surface that is configured to contact the complementary electrical contact when the electrical contact is mated with the complementary electrical contact.

2. The electrical contact as recited in claim 1, wherein the contact surface is arc-shaped.

3. The electrical contact as recited in claim 1, wherein the mating portion defines a recess in the inner surface of the other of the first and second contact beams, the recess aligned with the contact member with respect to the transverse direction.

4. The electrical contact as recited in claim 1, wherein the mating portion defines a gap defined between the inner surfaces of the first and second contact beams, and the contact surface is aligned with the gap along the lateral direction.

5. The electrical contact of claim 1, wherein the at least one contact member is a first contact member that extends from the inner surface of the first contact beam, the electrical contact further comprising a second contact member that extends from the inner surface of the second contact beam along a direction toward the first contact beam, the second contact member defining a contact surface configured to contact the complementary electrical contact when the electrical contact is mated with the complementary electrical contact.

6. The electrical contact as recited in claim 5, wherein the second contact member is spaced from the first contact member along the longitudinal direction.

7. The electrical contact as recited in claim 6, further comprising a tip that extends distally from the first and second contact beams, the tip defining a contact surface configured to contact the complementary electrical contact when the electrical contact is mated with the complementary electrical contact.

8. The electrical contact as recited in claim 7, wherein the contact surface of the tip is substantially aligned with the contact surfaces defined by the first and second contact members, respectively, along the longitudinal direction.

9. The electrical contact as recited in claim 1, wherein the at least one contact member defines first and second side surfaces opposite each other, at least one of the first and second side surfaces having a portion that lies in a corresponding plane defined by the longitudinal direction and a second direction that is angularly offset with respect to the transverse direction and the lateral direction.

10. The electrical contact as recited in claim 9, wherein the other of the first and second side surfaces has a portion that lies in a corresponding plane defined by the longitudinal direction and the second direction.

11. An electrical contact configured to mate with a complementary electrical contact of a second electrical connector along a mating direction, the electrical contact comprising:

a first contact beam having a first beam body, and a second contact beam having a second beam body, the first beam body spaced from the second beam body along a second direction that is substantially perpendicular to the mating direction so as to define a gap between the first beam body and the second beam body along the second direction, wherein when viewed along a third direction that is perpendicular to the mating direction and the second direction, at least one of the first and second contact beams includes at least one contact member that extends from the respective beam body into the gap toward the other beam body along the second direction, the at least one contact member further projecting out from the respective beam body along the third direction.

12. The electrical contact as recited in claim 11, wherein each of the first and second contact beams includes at least one contact member that extends from the respective beam body into the gap toward the other beam body along the second direction.

13. The electrical contact as recited in claim 12, wherein the contact members are spaced from each other along the mating direction.

14. An electrical connector configured to be mated with a complementary electrical connector along a mating direction, the electrical connector comprising:

a dielectric connector housing that defines a mating interface configured to be mated with the complementary electrical connector and a mounting interface configured to be mounted onto an electrical component; and at least one electrical contact carried by the connector housing, the electrical contact including a contact body that defines a mating portion elongate in the mating direction and configured to be electrically mated to a complementary electrical contact of the complementary electrical connector, the mating portion defining a first contact beam and a second contact beam spaced from the first contact beam along a second direction that is substantially perpendicular to the mating direction, wherein at least one of the first and second contact beams includes a beam body and a contact member that extends from the beam body along the both the second direction and a third direction that is substantially perpendicular to the both the mating and the second directions, such that at least a portion of the contact member is configured to make contact with the complementary electrical contact when the electrical connector is mated with the complementary electrical connector.

15. The electrical connector as recited in claim 14, wherein the first contact beam includes a first beam body that defines a first inner surface, the second contact beam includes a second beam body that defines a second inner surface that faces the first inner surface to at least partially define a gap between the first and second inner surfaces, the contact member is a first contact member that extends from the first inner surface, and the mating portion further includes a second contact member that extends from the second inner surface.

16. The electrical connector as recited in claim 15, wherein:

the first beam body further defines a first side and a second side that is spaced from the first side along the third direction, such that the first inner surface extends between the first and second sides of the first beam body; and the second beam body further defines a first side and a second side that is spaced from the first side along the third direction, such that the second inner surface extends between the first and second sides of the second beam body, wherein the first contact member defines a first contact surface and the second contact member defines a second contact surface, each of the contact surfaces configured to move along the complementary electrical contact in the mating direction as the electrical connector is mated with the complementary electrical connector.

17. The electrical connector as recited in claim 16, wherein when the electrical contact is viewed along the second direction, each of the first and second contact surfaces is arc-shaped and define an apex spaced from the respective first side along the third direction and configured to abut the complementary electrical contact of the complementary electrical connector when the electrical connector is mated with the complementary electrical connector.

18. The electrical connector as recited in claim 17, wherein each apex is disposed closer to the respective first side than the respective second side along the third direction.

19. The electrical connector recited in claim 18, wherein the first sides of the first and second contact beams extend along an offset plane defined by the mating direction and the second direction, the apex of the first contact surface is spaced from the offset plane in the third direction a first offset distance, and the apex of the second contact surface is spaced from the offset plane in the third direction a second offset distance.

20. The electrical connector recited in claim 19, wherein the first offset distance is equal to the second offset distance.

21. The electrical connector as recited in claim 19, wherein the mating portion further includes a tip that defines a free end of the mating portion, the tip defining a third contact surface that is curved and defines a third apex spaced from the offset plane in the third direction, the third apex configured to contact the complementary electrical contact when the electrical connector is mated with the complementary electrical connector.

22. The electrical connector as recited in claim 21, wherein the third apex is offset in the third direction a third offset distance from the offset plane, the third offset distance being no greater than the first offset distance and the second offset distance.

23. An electrical contact configured to mate with a complementary electrical contact of a second electrical connector along a longitudinal direction, the electrical contact comprising:

a mounting portion configured to electrically connect to a substrate, a mating portion configured to mate with mating portions of the complementary electrical contact, and an intermediate portion that is configured to be supported by a connector housing and extends between the mating portion and the mounting portion, wherein the mating portion includes 1) first and second contact beams spaced from each other along a transverse direction that is substantially perpendicular to the longitudinal direction, each of the first and second contact beams defining an inner surface that faces the inner surface of the other of the first and second contact beams, 2) at least one contact member that extends from the inner surface of at least one of the first and second contact beams along a direction that has a directional component toward the other of the first and second contact beams, and 3) a recess in the inner surface of the other of the first and second contact beams, the recess aligned with the at least one contact member with respect to the transverse direction, the at least one contact member defining a contact surface configured to contact the complementary electrical contact when the electrical contact is mated with the complementary electrical contact.

24. The electrical contact as recited in claim 23, wherein the contact member defines at least one side surface having a portion that lies in a corresponding plane defined by the longitudinal direction and a second direction that is angularly offset with respect to the transverse direction and a lateral direction that is substantially perpendicular to both the transverse direction and the longitudinal direction.

25. The electrical contact of claim 23, wherein the at least one contact member is a first contact member that extends from the inner surface of the first contact beam, the electrical contact further comprising a second contact member that extends from the inner surface of the second contact beam along a direction toward the first contact beam, the second contact member defining a contact surface configured to contact the complementary electrical contact when the electrical contact is mated with the complementary electrical contact.

26. The electrical contact as recited in claim 25, further comprising a tip that extends distally from the first and second contact beams, the tip defining a contact surface configured to contact the complementary electrical contact when the electrical contact is mated with the complementary electrical contact.

* * * * *

UNITED STATES PATENT AND TRADEMARK OFFICE

CERTIFICATE OF CORRECTION

PATENT NO. : 9,077,094 B2
APPLICATION NO. : 13/711103
DATED : July 7, 2015
INVENTOR(S) : Minich It is certified that error appears in the above-identified patent and that said Letters Patent is hereby corrected as shown below:

In the claims

COL. 18 Claim 14, lines 8 and 10, delete “the both” and substitute therefore --both--

Signed and Sealed this
Twenty-fourth Day of November, 2015

Michelle K. Lee

Michelle K. Lee
*Director of the United States Patent and Trademark Office*